United States Patent [19]

Jones

[11] 4,187,049

[45] Feb. 5, 1980

[54] GATHERING BLADE APPARATUS FOR ASSISTING IN LOADING THE BUCKET ON A FRONT-END LOADER

[76] Inventor: Fred E. Jones, Rte. 4, Box 50 D, Tulsa, Okla. 74354

[21] Appl. No.: 809,635

[22] Filed: Jun. 24, 1977

[51] Int. Cl.[2] ..... E02F 3/81

[52] U.S. Cl. ..... 414/704; 414/725

[58] Field of Search ..... 214/767, 146 E, 510

[56] References Cited

U.S. PATENT DOCUMENTS

| | | | |
|---|---|---|---|
| 2,705,082 | 3/1955 | Heimsoth | 214/767 |
| 2,768,760 | 10/1956 | Pilch | 214/767 |
| 3,067,888 | 12/1962 | Reynolds | 214/767 |
| 3,455,477 | 7/1969 | Blair | 214/767 |
| 3,520,432 | 7/1970 | Muotka et al. | 214/146 E |

*Primary Examiner*—Joseph F. Peters, Jr.

*Assistant Examiner*—Ross Weaver

*Attorney, Agent, or Firm*—Head & Johnson

[57] ABSTRACT

A gathering blade is mounted on a vehicle which carries a front end loading bucket, so that material can be gathered by the blade and pulled onto the bucket. The gathering blade is mounted on the ends of a pair of arms which are slidable longitudinally in a pair of guides, one on either side of the vehicle, and preferably in the planes of the control and operating arms of the bucket. The blade can be lifted up under the arms, which can then be retracted by means of hydraulic and pistons. The guides are rotatable about an axis attached to the vehicle, and are supported by pistons and cylinders from the operating arms, so that the bucket has full freedom of movement in an upwardly direction, and the blade does not obstruct the view of the operator.

2 Claims, 4 Drawing Figures

GATHERING BLADE APPARATUS FOR ASSISTING IN LOADING THE BUCKET ON A FRONT-END LOADER

BACKGROUND OF THE INVENTION

1. Field of the Invention

This invention lies in the field of earth-moving equipment. More particularly, it concerns an improvement in a front-end loading bucket apparatus mounted on and operated from a suitable vehicle.

Still more particularly, it concerns a type of gathering blade that can be moved longitudinally in the direction of the axis of the vehicle, and so can be used to gather material in front of the bucket and draw it backward into the bucket.

2. Description of the Prior Art

In the prior art there are a number of systems utilizing combinations of a loader bucket, and an articulated gathering cover, that is mounted for rotation on the top of the bucket. To a limited extent these covers can be moved in a way to gather material from in front of a bucket and to load it into a bucket. However, none of the art has shown the possibility of providing a gathering blade that is independently movable with respect to the vehicle, rather than movable with respect to the bucket, and thus such a blade is much more capable of moving material in the vicinity of the bucket than is possible when the gathering cover is directly attached to the bucket itself.

SUMMARY OF THE INVENTION

It is a primary object of this invention to provide a gathering blade which is independently mounted on a suitable vehicle, on which there is also mounted an earth-moving bucket, which can be lifted to be unloaded, and can be lowered to be used as a scoop to gather material.

It is a further object of this invention to provide a gathering blade which is hingedly mounted in a vertical plane from a pair of arms connected to a pair of spaced-apart, parallel, longitudinal guides, which are hingedly mounted on the sides of a suitable vehicle. Thus, the arms holding the blade can be moved longitudinally, positioning the blade farther from or closer to the bucket, in front of the bucket. The gathering blade can be lifted up under the guides when not in use so as to provide a minimum obstruction to the view of the operator.

By providing a suitable length of operating hydraulic cylinder and piston, any desired range of motion of the gathering blade in front of the bucket can be provided, so that the material can be gathered from corners, and from areas into which the vehicle and bucket cannot be positioned.

By making the support for the gathering blade cooperative with the operating arms of the bucket, there is greater freedom for movement of the blade and, therefore, greater ability to move the material down off a pile and back toward the bucket, to and into the bucket.

The lifting cylinders for the guides are supported from the operating arms of the bucket, so that when the bucket is lifted, the blade is also lifted.

It is also possible to use the blade as a cover for the bucket so that long pieces of material that do not fit inside of the bucket can still be carried by pressure on the material while between the blade and the bucket, and lifted into loading position onto a suitable vehicle.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENTS

Figure 1:
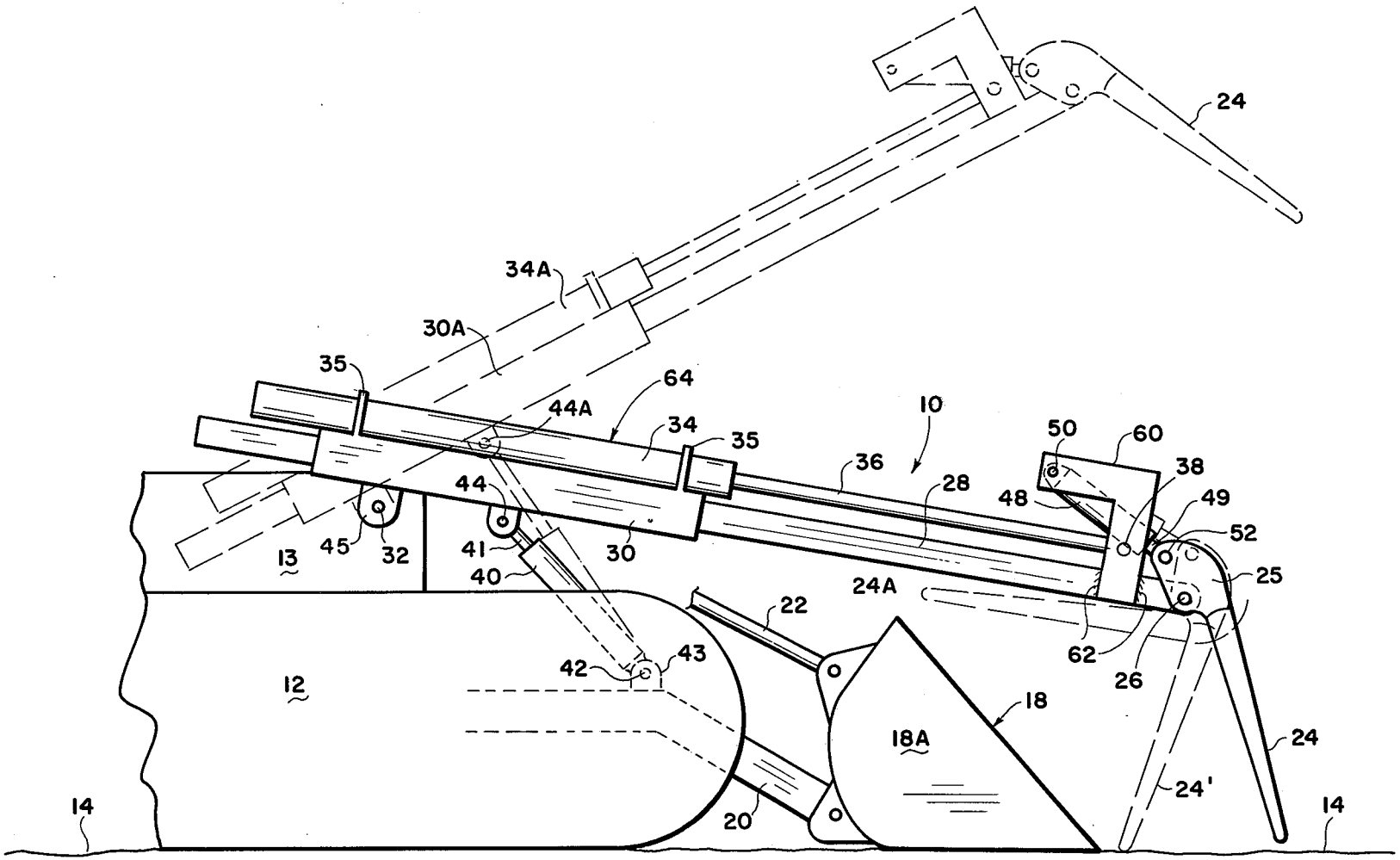
FIG. 1 illustrates a side elevation view of a vehicle having a loading bucket, and fitted with a gathering blade according to this invention.

Referring now to the drawings, there is shown in FIG. 1 a side elevation view of one embodiment of this invention, indicated generally by the numeral 10. It is mounted on a vehicle 13, 12 which can be a conventional track-laying tractor, or rubber-tired type of vehicle, commonly used for supporting a front bucket 18 of the conventional type. The bucket is supported by conventional operating arms 20 for lifting purposes, and by control arms 22 for tilting purposes. No further detail of the vehicle or the bucket and its arms are shown, since all details of the vehicle and bucket are well known in the industry.

This invention is related solely to the gathering blade 24 and its operating mechanism. The blade 24 is mounted in a generally vertical plane, transverse to the longitudinal axis of the vehicle, and is supported by a pair of support arms 28 which are guided longitudinally by a pair of spaced-apart, parallel guides 30, of which one is mounted on each side of the vehicle. The blade 24 is capable of being moved longitudinally from an outermost position in front of the bucket 18 to an innermost position indicated by the numeral 24A shown in FIG. 2 in retracted position, by means of piston rods 36 and cylinders 34, attached to the guides 30 by brackets 35.

Figure 3:
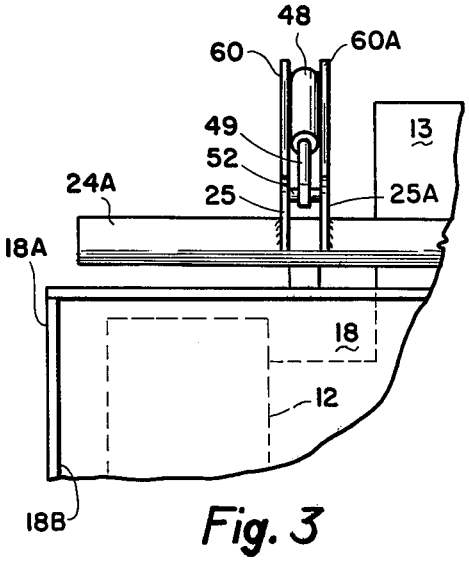
FIG. 3 is a front elevation view of the apparatus of this invention taken along the plane 3—3 of FIG. 2.

Reference to FIG. 3 illustrates that the blade 24 is slightly shorter than in a transverse dimension, than is the bucket 18 so that it can be moved into the bucket, not only to retain material inside the bucket, but to compress material in the bucket, and also to clean out the bucket.

The blade has two pairs of ears 25 welded to its top edge, by means of which it is hinged by means of pins 26 to the ends of arms 28. Near their ends, the two arms 28 have support plates 60 attached as by welds 62 in FIG. 1. These support a hydraulic cylinder 48 by means of hinge pin 50. The piston rod 49 is attached by pin 52 to the ears 25. Thus by control of pressure fluid to cylinder 48 the blade 24 can be moved from the position 24 shown in FIG. 1 to the dashed position 24'. It can also be rotated up under the arms, in a substantially horizontal plane, 24A, and retracted, as shown in FIG. 2.

The guides 30 (one on each side of the vehicle 13, 12) have mounting plates 45 which permit rotation about axis 32. A hydraulic cylinder 40 is attached by pin 42 to the support ears 43 attached to the operating arms 20 of the bucket. By extending the piston rod 41 of cylinder 40 the guides can be lifted as shown by the dashed outline 30A, etc. in FIG. 1. Thus, the gathering blade can be extended upwardly and forwardly, so as to knock down earth, or salvaged material, or other material from a pile, and to carry it backwardly into the bucket so as to load the bucket.

The arms 28 that support the blade are extendable and retractable by means of a hydraulic cylinder 34 which is attached to the guides 30 by means of brackets 35, for example. The piston rods 36 are attached at their outer ends by pins 38 to a pair of brackets or ears 60, which are welded to the supporting arms 28. By operating the hydraulic cylinder the arms 28 can then be moved longitudinally into or out of the guides 30, and can be lifted by operation of the hydraulic cylinder 40, for example.

Figure 2:
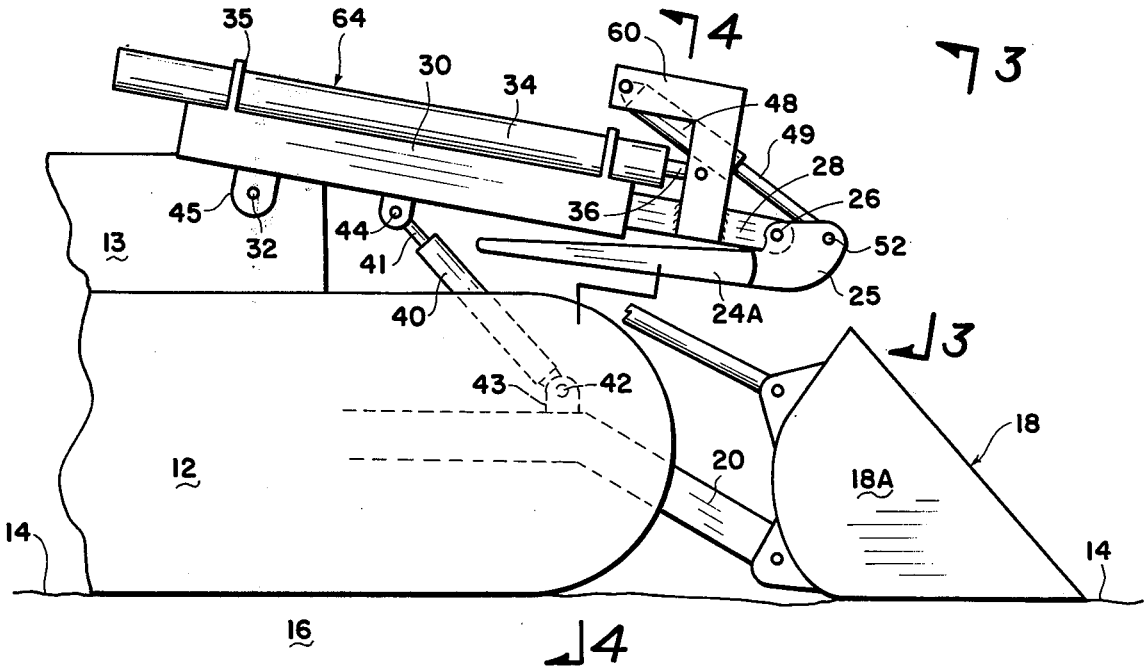
FIG. 2 is a side elevation view showing the front portion of the vehicle, with the blade lifted and retracted.

In FIG. 2 the arms 28 are shown retracted with the blade in position 24A under the arms. This would normally be the position when the blade is not in use. In this position the piston rod 41 can be extended or withdrawn, etc. However, if the bucket 18 is lifted by arms 20, then, even though the length of the piston rod 41 and cylinder 40 is unchanged, the guides 30 will also be raised and the blade will offer no obstruction to the bucket, or to the view of the operator.

In FIG. 3 is shown a partial view of the apparatus of FIG. 2, taken across the plane 3—3. Here the top edge of the blade 24A is seen, with the ears 25, 25A welded to the top edge. The cylinder 48 is shown in position between the supports 60, 60A with the piston rod 49 attached by pin 52 to ears 25, 25A.

An outline of the vehicle 13 is shown, and the track mechanism 12. The top portion of the bucket 18 is shown extending laterally beyond the outer edges of the tracks. The blade 24A is slightly shorter than the bucket, so that it can be moved into the bucket, to scrape the inner surface, or to hold material inside the bucket.

Figure 4:
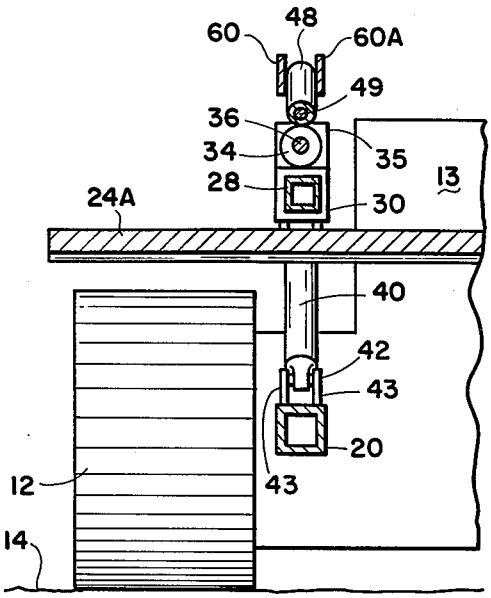
FIG. 4 is a front elevation view taken along the plane 4—4 of FIG. 2.

FIG. 4 shows a partial front elevation view taken along the planes 4—4 of FIG. 2. Here are shown the cylinder 48 between the support plates 60, 60A, and the piston rod 49. The end of the cylinder 34 is shown and piston rod 36. The cylinder is held in brackets 35 attached to the top of the guide 30 (of square tubing, for example) and arm 28 which slides inside the guide 30.

Also shown is the cylinder 40 which supports the guides. The cylinder 40 is supported by pin 42 in support lugs 43, 43 welded to operating arm 20 of the bucket. The balde 24A extends laterally out beyond the tracks 12, but as shown in FIG. 3, not as far as the inner wall 18B of the bucket 18.

The type of construction illustrated in the figures is such that the apparatus of this invention can be retrofitted to existing equipment, (or designed as part of new equipment). Also the type of construction prevents interference with the normal use of the bucket, while allowing full use of the blade, as needed. The wide blade permits rapid movement of material into the bucket, and compacting the material in the bucket.

What has been described in a gathering blade apparatus for use in moving earth and other material into the open front of an earth mover or front loader bucket. The blade is mounted to the vehicle independently of but cooperatively with the bucket. The blade has a large range of longitudinal motion which permits it to gather material from a considerable distance in front of the bucket, and move it into the bucket. The blade also has a considerable movement in a vertical direction so that it can be used to pull down material from a pile of dirt or debris, down to ground level, and then to load it into the bucket.

The use of the blade can be very effective when the material to be loaded into the bucket involves large and cumbersome, hard-to-handle pieces, such as broken concrete, both large and small pieces, small trees or tree parts, stumps, branches, limbs, etc., that cannot be conveniently loaded onto a bucket by simply pushing a bucket into a pile of such material. The blade can also be used for breaking, levelling, smoothing, and last-bit removal of material. It eliminates manual loading of the bucket by laborers, and is more adaptable to loading the bucket than is, for example, the use of an articulated cover.

The blade forces packing of material into the bucket, and thus insures a full bucket. Thus, it can move more material with fewer lifting operations, in less time, involving a movement of a greater volume of scrap material. It avoids the necessity of breaking up long, awkward-to-handle, pieces of material, and so on, such as building or wrecking material, scrap plaster board, strip material, old lumber, and wooden parts, etc. Furthermore, it can be used to load material onto the bucket even though the bucket is not in a normal loading position. This permits loading wet material onto the bucket, while the bucket is tilted downward to the front, in order to drain any liquid from the material being loaded onto the bucket.

It will be clear that while the preferred use for this invention is in connection with front loaders, it can also be used, with a narrower blade as a loading blade, for back hoes and the like.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A gathering blade apparatus for attachment to a vehicle having an earth-moving bucket supported by longitudinal operating arms, of conventional design, comprising;

(a) a gathering blade comprising a blade positioned transverse to the longitudinal axis of the vehicle, by hinge means near its top edge, to a pair of spaced-apart, parallel blade support arms;

means to rotate the plane of said gathering blade a selected angle from forward of the vertical, to substantially horizontal, under said blade support arms, the transverse length of said blade being less than the transverse length of said bucket;

(b) a pair of guide means supported by horizontal hinge means to said vehicle, and extending parallel to the longitudinal axis of said vehicle, said guide means adapted to receive and to longitudinally guide said blade support arms;

(c) a pair of hydraulic cylinders and pistons attached to said guide means, and piston rod means, attached at their outer ends to the outer ends of said blade support arms; whereby operation of said piston serves to move said support arms and said blade between positions forwardly or rearwardly, with respect to said bucket;

(d) means to rotate said guide means about said horizontal hinge means with respect to said bucket operating arms;

whereby said blade can be raised and lowered independently; and wherein, said blade will be raised whenever said bucket is raised.

2. The apparatus as in claim 1 in which said means to rotate said guide means comprises cylinder and piston means connected between said guide means and said operating arm of said bucket.

* * * * *